US008961224B2

(12) United States Patent
Grek et al.

(10) Patent No.: US 8,961,224 B2
(45) **Date of Patent: *Feb. 24, 2015**

(54) COUPLING SYSTEM FOR ELECTRICAL CONNECTOR ASSEMBLY

(71) Applicant: Amphenol Corporation, Wallingford, CT (US)

(72) Inventors: Joachim Ivan Grek, Katrineholm (SE); Owen Robert Barthelmes, Putnam Valley, NY (US); Michael Andrew Hoyack, Sandy Hook, CT (US)

(73) Assignee: Amphenol Corporation, Wallingford, CT (US)

( * ) Notice: Subject to any disclaimer, the term of this patent is extended or adjusted under 35 U.S.C. 154(b) by 38 days.

This patent is subject to a terminal disclaimer.

(21) Appl. No.: 13/759,445

(22) Filed: Feb. 5, 2013

(65) Prior Publication Data

US 2013/0157506 A1 Jun. 20, 2013

Related U.S. Application Data

(63) Continuation-in-part of application No. 13/085,058, filed on Apr. 12, 2011, now Pat. No. 8,388,374.

(51) Int. Cl.

| | |
|---|---|
| ***H01R 9/05*** | (2006.01) |
| ***H01R 13/622*** | (2006.01) |
| ***H01R 13/639*** | (2006.01) |
| ***H01R 24/40*** | (2011.01) |
| ***H01R 24/52*** | (2011.01) |
| *H01R 103/00* | (2006.01) |

(52) U.S. Cl.

CPC ..... *H01R 9/0503* (2013.01); *H01R 9/0521* (2013.01); *H01R 13/622* (2013.01); *H01R 13/6395* (2013.01); *H01R 24/40* (2013.01); *H01R 24/52* (2013.01); *H01R 2103/00* (2013.01)

USPC ..... 439/578

(58) Field of Classification Search

USPC ..... 439/578–585, 319

See application file for complete search history.

(56) References Cited

U.S. PATENT DOCUMENTS

| | | | | |
|---|---|---|---|---|
| 3,287,031 | A * | 11/1966 | Simmons et al. | 285/27 |
| 3,332,052 | A * | 7/1967 | Rusinyak | 439/318 |
| 3,665,371 | A * | 5/1972 | Cripps | 439/319 |
| 3,747,048 | A | 7/1973 | Johnson et al. | |

(Continued)

FOREIGN PATENT DOCUMENTS

| | | | |
|---|---|---|---|
| EP | 2511990 | A2 | 10/2012 |
| WO | WO-2012138644 | A2 | 10/2012 |

*Primary Examiner* — Gary Paumen

(74) *Attorney, Agent, or Firm* — Blank Rome LLC

(57) ABSTRACT

An electrical connector assembly that comprises a first connector member supporting a first contact and has a first interface end that defines a first tapered surface, and a second connector member supporting a second contact and has a second interface end that mates with the first interface end. The second interface end has a second tapered surface. The first and second tapered surfaces have substantially the same angle of taper and taper in opposite directions to engage one another to form a friction fit. A coupling member is mounted near one of the interface ends and has an external engagement member that is configured to engage a corresponding external engagement member. A biasing member is disposed in an annular receiving area. The coupling member is movable between an unlocked position when the external engagement members are not engaged and a locked position when the external engagement members are engaged.

25 Claims, 9 Drawing Sheets

(56) References Cited

U.S. PATENT DOCUMENTS

| | | | | | |
|---|---|---|---|---|---|
| 3,835,443 | A | * | 9/1974 | Arnold et al. | 439/319 |
| 3,871,735 | A | | 3/1975 | Herrmann, Jr. | |
| 3,945,701 | A | | 3/1976 | Boeke et al. | |
| 3,976,352 | A | | 8/1976 | Spinner | |
| 4,068,911 | A | * | 1/1978 | Lodato et al. | 439/319 |
| 4,296,986 | A | | 10/1981 | Herrmann, Jr. | |
| 4,405,196 | A | | 9/1983 | Fulton | |
| 4,553,807 | A | | 11/1985 | Cane | |
| 4,746,305 | A | * | 5/1988 | Nomura | 439/319 |
| 5,662,489 | A | | 9/1997 | Stirling | |
| 5,713,765 | A | | 2/1998 | Nugent | |
| 5,816,835 | A | | 10/1998 | Meszaros | |
| 6,176,716 | B1 | | 1/2001 | Mercurio et al. | |
| 6,568,949 | B1 | * | 5/2003 | Walters | 439/319 |
| 6,953,359 | B1 | * | 10/2005 | Morelli | 439/319 |
| 6,955,563 | B1 | | 10/2005 | Croan | |
| 7,972,158 | B2 | | 7/2011 | Wild et al. | |

* cited by examiner

COUPLING SYSTEM FOR ELECTRICAL CONNECTOR ASSEMBLY

RELATED APPLICATION

This application is a continuation-in-part of U.S. patent application Ser. No. 13/085,058, filed Apr. 12, 2011, the subject matter of which is incorporated herein.

FIELD OF THE INVENTION

The present invention relates to a coupling system for an electrical connector assembly. More specifically, the coupling system includes both inner and outer engagements that provide a secure connection between the components of the connector assembly to prevent loosening thereof due to movement or vibration of the components

BACKGROUND OF THE INVENTION

The interconnection between components of an electrical connector assembly, such as a plug and receptacle, is critical to maintaining the proper electrical connection therebetween. Often conventional electrical connector assemblies loosen, particularly when subjected to vibration. Such loosening compromises the integrity of the electrical connection between the components.

Examples of conventional electrical connector assemblies are found in U.S. Pat. No. 4,556,807 to Cane, U.S. Pat. No. 4,296,986 to Herrmann, Jr., and U.S. Pat. No. 4,405,196 to Fulton, the subject matter of each of which is herein incorporated by reference.

SUMMARY OF THE INVENTION

Accordingly, the present invention provides an electrical connector assembly that comprises a first connector member that includes a first connector body supporting a first contact, the first connector body having a first interface end that defines a first tapered surface, and a second connector member that includes a second connector body supporting a second contact configured to mate with the first contact, the second connector body having a second interface end that mates with the first interface end of the first connector member, the second interface end of the second connector member having a second tapered surface configured to mate with the first tapered surface. The first and second tapered surfaces have substantially the same angle of taper and taper in opposite directions to engage one another in a friction fit to form an inner engagement between the first and second connector members. A coupling member is mounted near one of the first and second interface ends of the first and second connector bodies, respectively. The coupling member has an external engagement member that is configured to engage a corresponding external engagement member of the other of the first and second connector bodies to form an outer engagement between the first connector member and the second connector member. A biasing member is disposed in an annular receiving area defined between an inner surface of the coupling member and the one of the first and second connector bodies to which the coupling member is mounted, thereby biasing the coupling member toward the one of the first and second interface ends. The coupling member is movable between an unlocked position when the external engagement members are not engaged and a locked position when the external engagement members are engaged.

The present invention also provides an electrical connector assembly that comprises a plug member that includes a plug body that supports a male contact, the plug body having an interface end and a cable termination end opposite the interface end, and the interface end of the plug body defines a first tapered surface which tapers inwardly toward a central longitudinal axis of the plug body. A receptacle member includes a receptacle body that supports a female contact configured to receive the male contact, the receptacle body having an interface end that mates with the interface end of the plug member and an equipment end opposite the interface end, and the interface end of the receptacle member having a second tapered surface, the second tapered surface tapers outwardly away from a central longitudinal axis of the receptacle body. The first and second tapered surfaces have substantially the same angle of taper and engage one another to form an inner friction fit engagement between the plug member and the receptacle member. A sleeve member is rotatably mounted to the plug member near the interface end of the plug body, the sleeve member having an external engagement member configured to engage a corresponding external engagement member of the receptacle body to form an outer engagement between the plug member and the receptacle member. A biasing member is disposed in an annular receiving area defined between an inner surface of the sleeve member and the plug body biasing the sleeve member toward the interface end of the plug member. The sleeve member is movable between an unlocked position when the external engagement members are not engaged and a locked position when the external engagement members are engaged.

The present invention also provides an electrical connector assembly that comprises a plug member that includes a plug body that supports a pin contact, the plug body having an interface end and a cable termination end opposite the interface end, and the interface end of the plug body defines a first tapered surface which tapers inwardly toward a central longitudinal axis of the body. A receptacle member includes a receptacle body that supports a socket contact configured to receive the pin contact of the plug member, the receptacle body having an interface end that mates with the interface end of the plug member and an equipment end opposite the interface end, and the interface end of the receptacle member having a second tapered surface, the second tapered surface tapers outwardly away from a central longitudinal axis of the receptacle body. The first and second tapered surfaces have substantially the same angle of taper and engage one another to form an inner friction fit engagement between the plug member and the receptacle member. A sleeve member is rotatably mounted to the plug member near the interface end of the plug body. The sleeve member has at least one bayonet channel configured to engage a corresponding detent of the receptacle body to form an outer engagement between the plug member and the receptacle member. A spring is disposed in an annular receiving area defined between an inner surface of the sleeve member and the plug body biasing the sleeve member toward the interface end of the plug member. The sleeve member is movable between an unlocked position when the bayonet channel and detent are not engaged and a locked position when the bayonet channel and detent are engaged such that the detent abuts a hook end of the bayonet channel.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
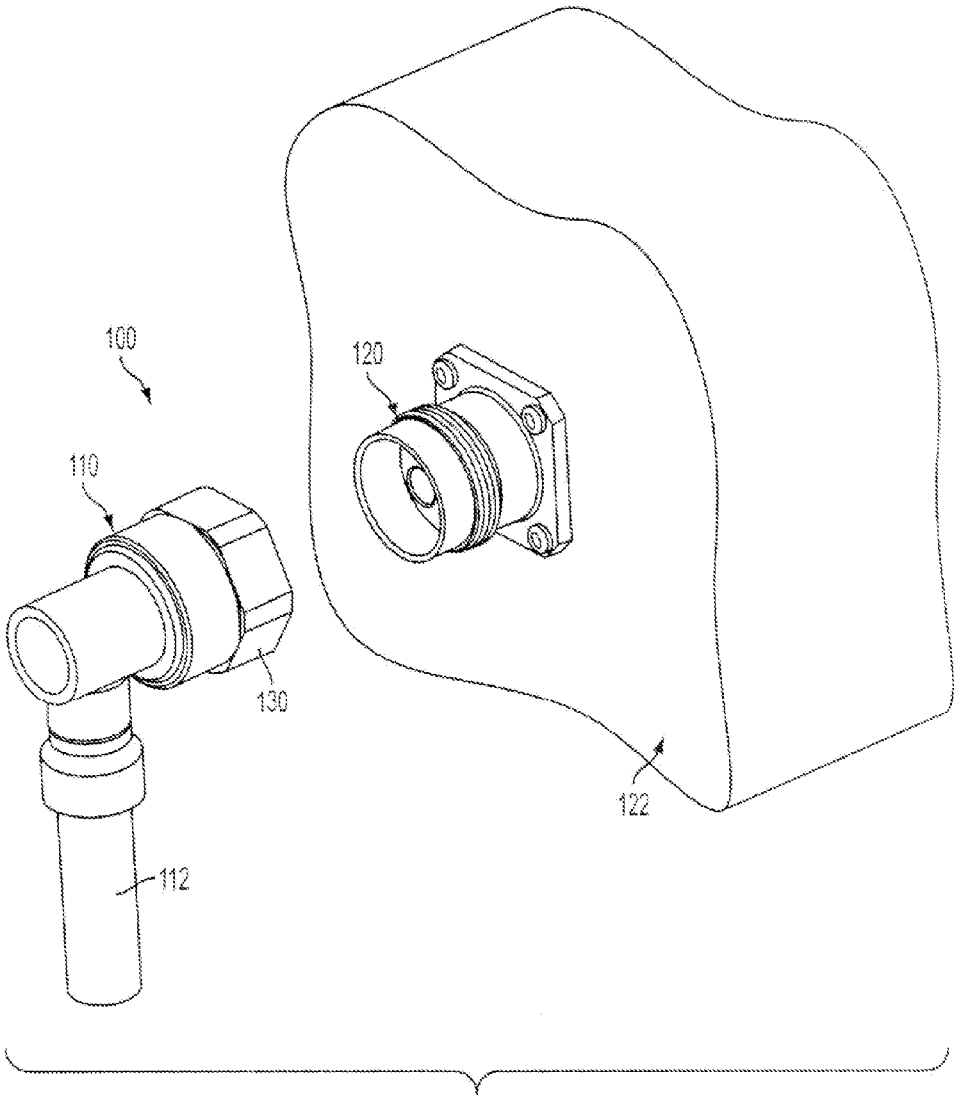
FIG. 1 is an exploded perspective view of an electrical connector assembly according to an exemplary embodiment of the present invention, showing the components of the connector assembly connected to a cable and equipment panel, respectively.

Referring to FIGS. 1-3, 4A and 4B, the present invention generally relates to an electrical connector assembly 100 that includes a coupling system for securely mating the components of the connector assembly even during movement, such as vibration. In general, the coupling system includes both an inner engagement and an outer engagement between the connector assembly components to positively secure the connector components both mechanically and electrically.

The components of the electrical connector assembly 100 generally include first and second connector members 110 and 120, such as a plug and mating receptacle. The plug member 110 preferably connects to and terminates a cable 112, such as a coaxial cable, in a manner well known in the art. The receptacle member 120 preferably connects to an equipment panel 122, such as equipment used in wireless base station applications, e.g. transceivers, filters, amplifiers, antennas and the like.

Figure 2:
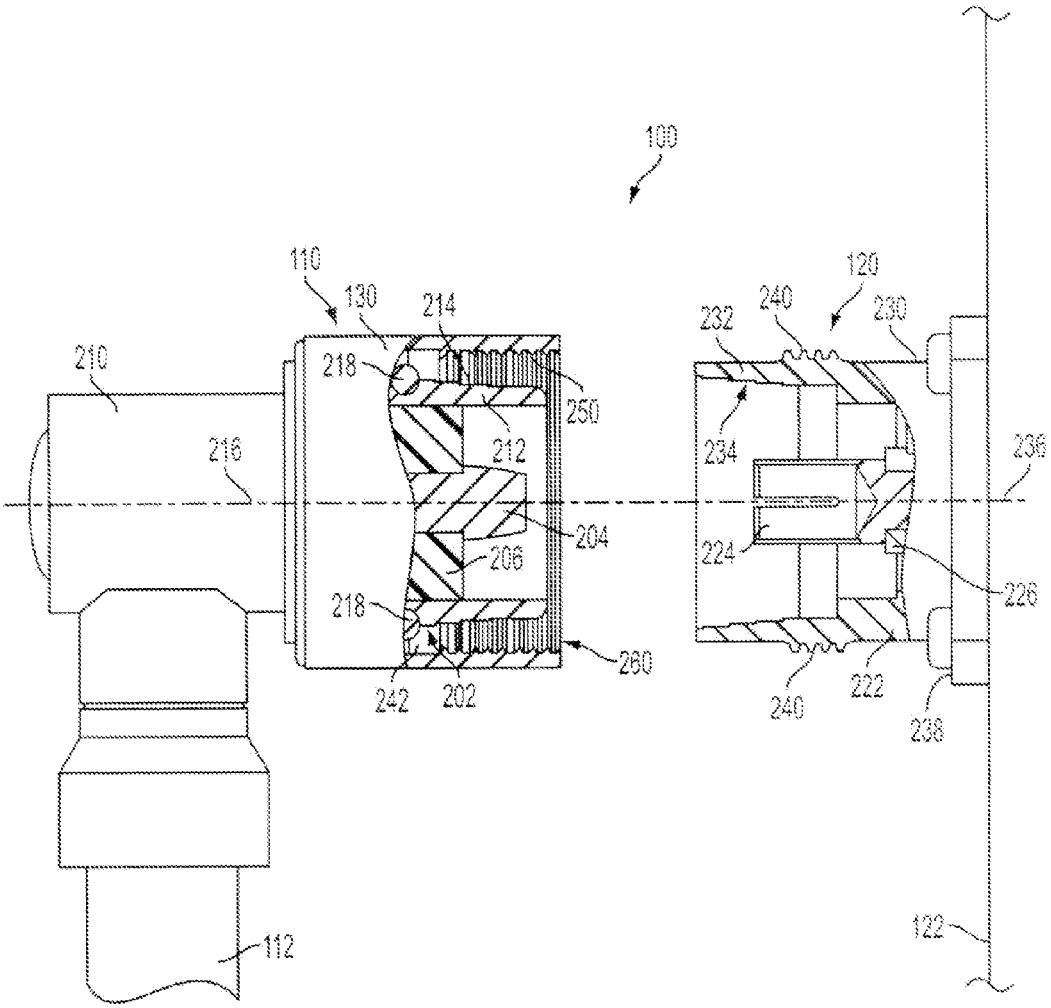
FIG. 2 is an exploded elevational view in partial section of the electrical connector assembly illustrated in FIG. 1, showing the components of the connector assembly in the disassembled state.

The plug member 110 may include a plug body 202 that internally supports a contact 204, such as a male contact or pin. The pin 204 is particularly supported by an insulator 206. The plug member 110 includes one end 210 that terminates the cable 112 and an interface end 212, opposite the end 210 that interfaces with the receptacle member 120. As best seen in FIG. 2, the interface end 212 has a substantially conical shape that defines an outer tapered surface 214. The outer tapered surface 214 slopes inwardly toward a central longitudinal axis 216 of the plug body 202 and to the distal end of the plug body interface end 212 (e.g. shown tapering inwardly from left-to-right in FIG. 2).

The outer surface of the plug body 202 may also include an annular groove that is preferably positioned adjacent the outer tapered surface 214 that receives a sealing groove 218. The plug body 110 is preferably formed of a substantially rigid material that may be conductive, such as metals like brass aluminum or zinc alloys as well as metalized plastic.

The receptacle member 120 may include a receptacle body 222 that internally supports a contact 224, such as a female contact or socket. The socket 224 is particularly supported by an insulator 226 and is adapted to receive the pin 204 of the plug member 110. The receptacle body 222 includes one end 230 that connects to the equipment panel 122. Opposite end 230 is an interface end 232 configured to couple with the interface end 212 of the plug member 110. The interface end 232 of the receptacle body 222 has an inner tapered surface 234 that corresponds to the outer tapered surface 214 of the plug body 202 to form a friction fit therebetween when the plug and receptacle members 110 and 120 are assembled. The inner tapered surface 234 slopes outwardly away from a central longitudinal axis 236 of the receptacle body 222 and to the distal end of the receptacle body interface end 232 (e.g. shown tapering outwardly from right-to-left in FIG. 2).

The receptacle body 222 includes an engagement member 240 on its outer surface. The engagement member 240 is preferably a plurality of threads at or near the interface end 232 of the receptacle body 222. The receptacle body 222 is mounted to the equipment panel 122 at its end 230 by a mounting flange 238. Like the plug body, the receptacle body 222 is preferably formed of a substantially rigid material that may be conductive.

As seen in FIG. 1, a coupling member 130 externally engages the plug and receptacle members 110 and 120. The coupling member 130 is preferably rotatably mounted to the plug body 110 by a ring clip 242. The coupling member 130 may include an engagement member 250 that corresponds to and engages the engagement member 240 of the receptacle body 222. The coupling member 130 is preferably a nut wherein the engagement member 250 is a plurality of threads disposed on its inner surface that engage the plurality of threads 240 on the outer surface of the receptacle body 222.

Figure 3:
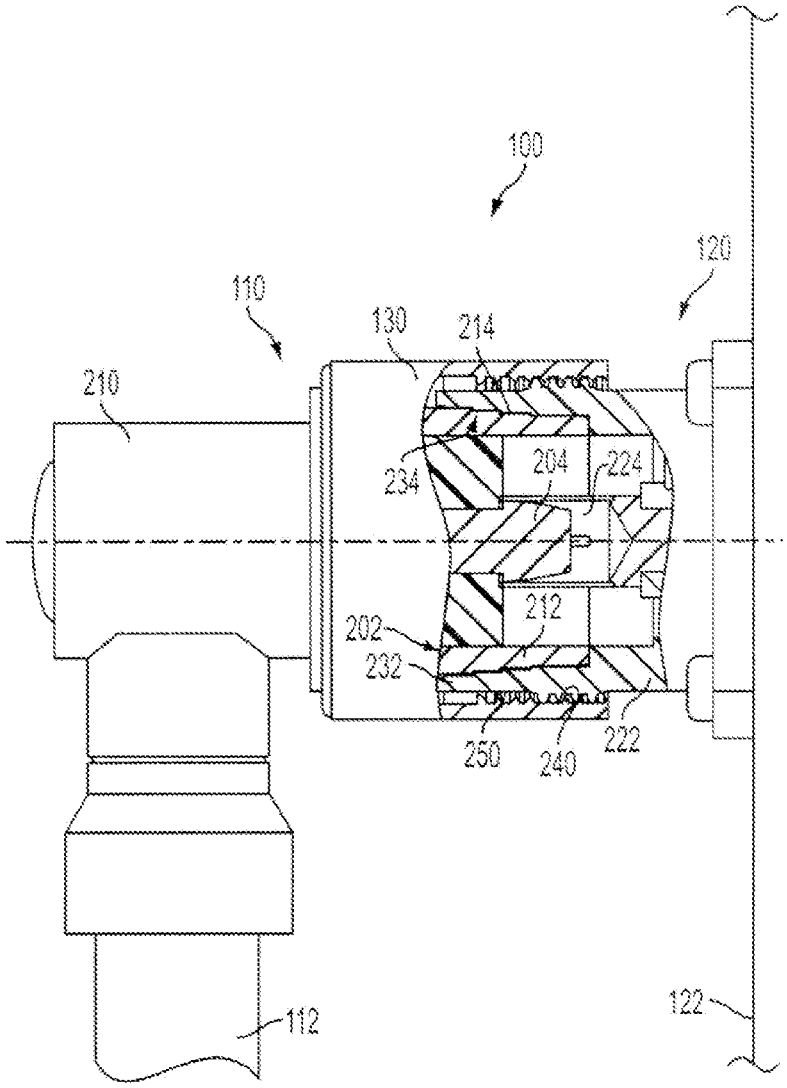
FIG. 3 is an elevational view in partial section of the electrical connector assembly illustrated in FIG. 1, showing the components of the connector assembly in the assembled state.

An annular receiving area 260 is defined between the outer tapered surface 214 of the plug body 202 and the inner surface of the coupling member 130 that is configured to receive the interface end 232 of the receptacle body 222. As seen in FIG. 3, when the plug and receptacle members 110 and 120 are mated, the interface end 232 of the receptacle body 222 is inserted into the annular receiving area 260 (FIG. 2) of the plug body 202 such that the outer tapered surface 214 of the plug body 202 frictionally engages the inner tapered surface 234 of the receptacle body 222. That frictional fit of the tapered surfaces 214 and 234 forms an inner engagement for securing the plug and receptacle members 110 and 120 together.

The engagement member or threads 250 of the coupling member 130 and the engagement member or threads 240 on the outer surface of the receptacle body 222 engage to form an outer engagement between the plug member 110 and the receptacle member 120. Although it is preferable that the engagement members 240 and 250 be a plurality of threads, any known engagement or fastening mechanism may be used, such as a bayonet engagement. The combination of the inner engagement, that is the frictional fit between tapered surfaces 214 and 234, and the outer engagement, that is the threaded engagement between the coupling member 130 and the receptacle body 222, provides a secure engagement between the plug and receptacle member 110 and 120 that prevents loosening of the connection even during movement, such as vibration. That also maintains a positive electrical connection between the male and female contacts 204 and 224 of the plug and receptacle members 110 and 120 even during movement.

Figure 4B:
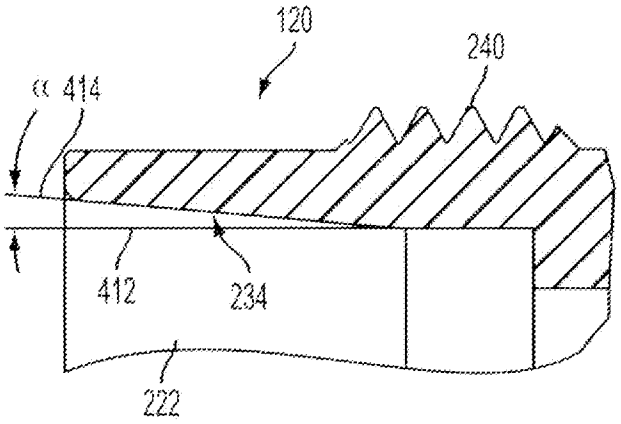
FIGS. 4A and 4B are partial elevational views in section of the interface ends of the components of the electrical connector assembly illustrated in FIG. 1, showing the angle of taper for each interface end.
Figure 4A:
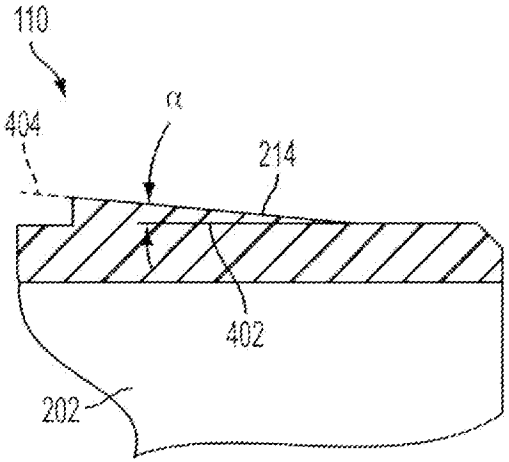

FIGS. 4A and 4B illustrate the preferred angle of taper α of the outer tapered surface 214 (FIG. 4A) of the plug member 110 and the inner tapered surface 234 (FIG. 4B) of the receptacle member 120. As seen in FIG. 4A, the angle of taper α is defined between a longitudinal axis 402 of the plug body 202 and the axis 404 defined by the outer tapered surface 214. As seen in FIG. 4B, the angle of taper α is defined between a longitudinal axis 412 of the receptacle body 222 and the axis 414 defined by the inner tapered surface 234. The angle of taper α is the same for both the outer and inner tapered surfaces 214 and 234 so that a positive friction fit is provided between the plug body 202 and the receptacle body 222. The angle of taper α is selected to provide the appropriate friction fit between the two bodies. That is, if the angle of taper α is too large, the friction fit between the plug and receptacle bodies 202 and 222 would be too loose and would not provide a secure engagement between the two components. On the other hand, if the angle of taper α is too small, the friction fit between the plug and receptacle bodies 202 and 222 would be too strong such that the plug and receptacle members 110 and 120 could not be separated. Testing was conducted on the plug and receptacle members 110 and 120 to determine the preferred angle of taper α. Specifically, pull tests were conducted that measure the force necessary to un-mate the plug and receptacle bodies 202 and 222 for various angles of taper α. The torque applied during testing included 1 Newton Meter, 1.5 Newton Meter, 2 Newton Meters, and 20 Newton Meters. Based on that testing, it was determined that the preferred angle of taper α is in the range of about 3.5° to 6.5°, and more preferably 5°, which provides a strong enough friction fit between the bodies 202 and 222 without it being overly difficult for the bodies 202 and 222 to be disengaged.

Figure 5A:
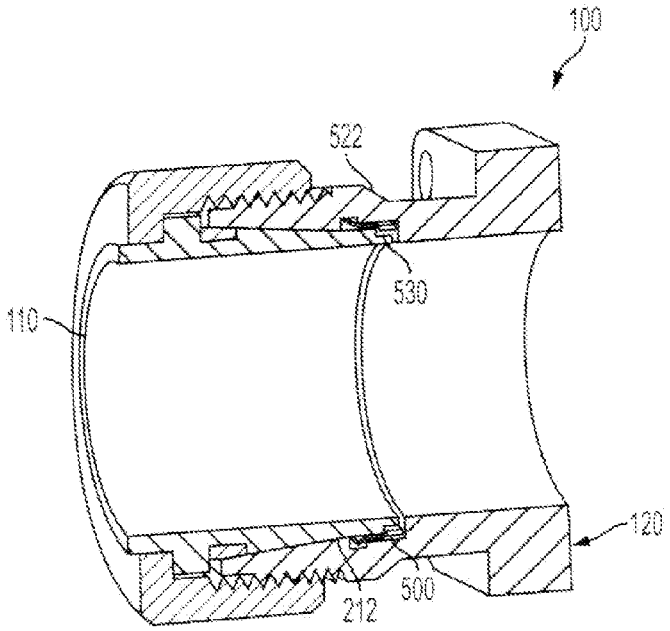
FIG. 5A is a sectional view of a connector assembly according to another exemplary embodiment of the invention, showing a biasing member between the connector components.
Figure 5B:
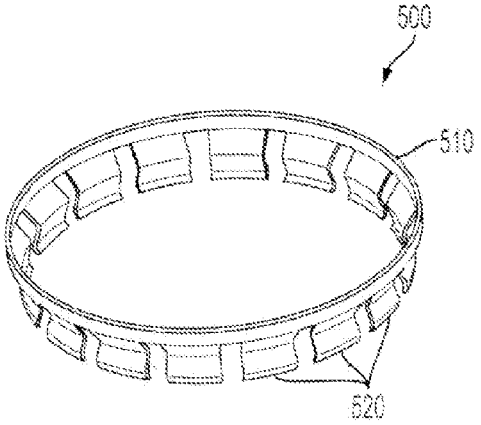
FIG. 5B is a perspective view of the biasing member illustrated in FIG. 5A.
Figure 6:
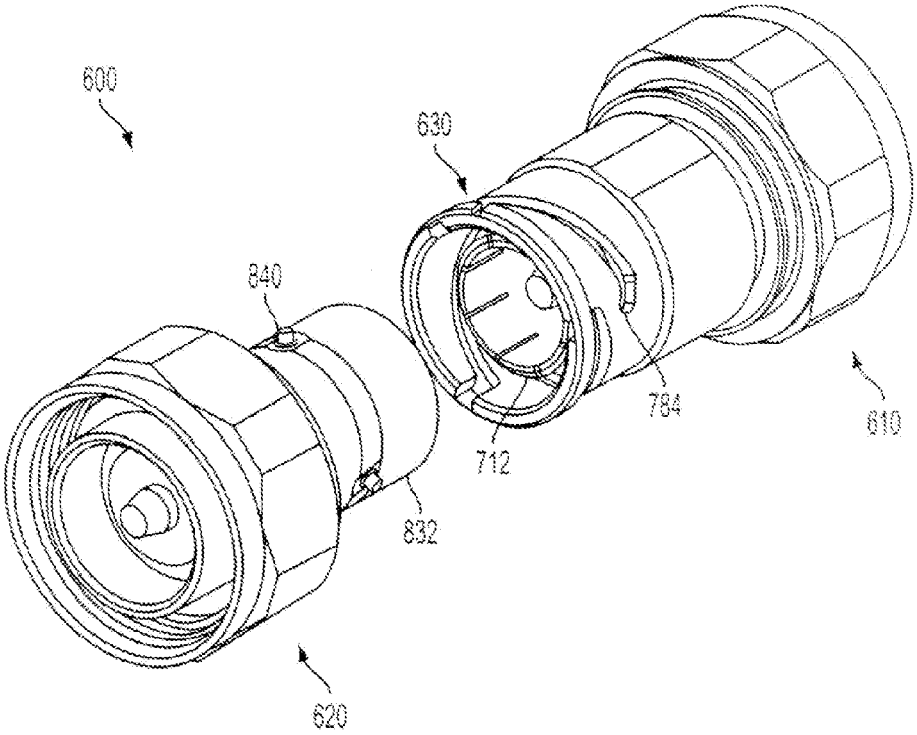
FIG. 6 is an exploded perspective view of an electrical connector assembly according to yet another exemplary embodiment of the present invention.

Referring to FIGS. 5A and 5B, the connector assembly 100 of the present invention may include a biasing member 500 located between the interface of the plug member 110 and the receptacle member 120. The biasing member 500 may be a spring, such as shown in FIG. 5B, that may include a ring body 510 with spaced resilient fingers 520 extending outwardly from the ring body 510. The spring 500 sits around the interface end 212 of the plug member 110 and inside a groove 530 of the receptacle body 222 such that the fingers 520 push against the receptacle body 222. The spring 500 preferably produces contact pressure radially to make electrical ground contact between the plug and receptacle bodies. The location of the spring 500, i.e. at the front of the plug member 110, is an optimal location for RF transmission, for example.

Referring to FIGS. 6, 7A, 7B, 8A, 8B, and 9, an electrical connector assembly 600 according to an alternative exemplary embodiment of the present invention includes first and second components 610 and 620 coupled together by inner and outer engagements. The inner engagement is preferably a taper fit similar to the first embodiment. The outer engagement includes a coupling member 630 that moves between locked and unlocked positions to positively mate and release the components 610 and 620. Like the first embodiment, the first component 610 is preferably a plug member that terminates a cable and the second component 620 is preferably a receptacle member that connects to equipment or an equipment panel.

Figure 7A:
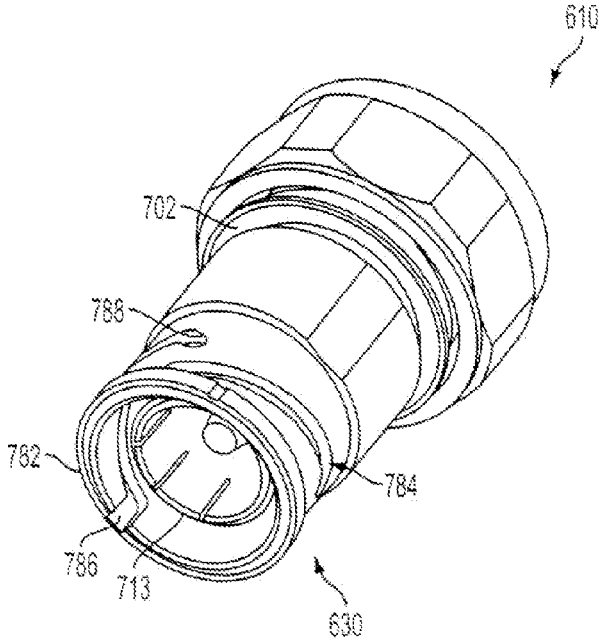
FIGS. 7A and 7B are perspective and cross-sectional views, respectively, of one component of the connector assembly illustrated in FIG. 6.
Figure 7B:
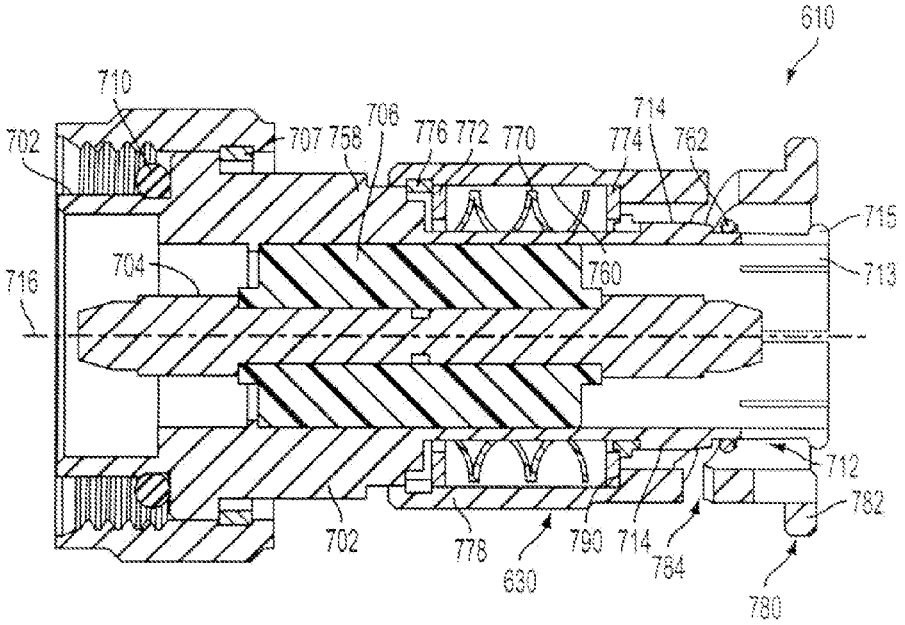

As seen in FIGS. 7A and 7B, the plug member 610 generally includes a plug body 702 that internally supports a contact 704, such as a male contact or pin, in an insulator 706. The plug member 610 includes a cable termination end 710 and an opposite interface end 712. The cable termination end 710 may be a threaded nut rotatably mounted on the plug body 702 by a retaining ring 707. The interface end 712 preferably includes a plurality of resilient grounding fingers 713 that form an annular lip 715 and their distal ends. A tapered surface 714 is located on the outer surface of the plug body 702 near the interface end 712 that slopes inwardly toward a central longitudinal axis 716 of the plug body 702, as best seen in FIG. 7B. At the end of the tapered surface 714 is an abutment ring 762, such as an O-ring, that acts to prevent the plug member 610 from being inserted too far into the receptacle member 620. The plug body's outer surface also includes at least one step 758 defining a annular receiving area 760 configured to hold a biasing member 770. First and second washers 772 and 774 also sit in the annular receiving area 760 with the biasing member 770 therebetween. The biasing member 770 is preferably a compression spring or a wave spring.

The coupling member 630 may be a sleeve that is rotatably and slidably mounted to the plug body 702 by one or more retaining rings 776. The coupling sleeve 630 has a generally cylindrical body 778 with one end 780 that engages the receptacle member 620. The end 780 of the coupling sleeve 630 includes an outer shoulder 782. One or more, preferably three, engagement members 784, are provided in the body 778 of the sleeve 630. The engagement members 784 are preferably curved ramped channels that each have an open access end 786 and an opposite hook end 788, as best seen in FIG. 7A. The open access ends 786 of the channels 784 are disposed in the outer shoulder 782 at the end 780 of the sleeve 630. The channels 784 are preferably arranged on the sleeve body 778 such that the open access ends 786 are aligned or nearly aligned with the hook ends 788 of the adjacent channels.

The sleeve body 778 covers the annular receiving area 760 of the plug body 702 such that the spring 770 is between the inner surface of the sleeve 630 and the outer surface of the plug body 702. The inner surface of the sleeve body also includes an inwardly extending shoulder 790 providing a stop for the spring 770 in the annular receiving area 760.

Figure 8A:
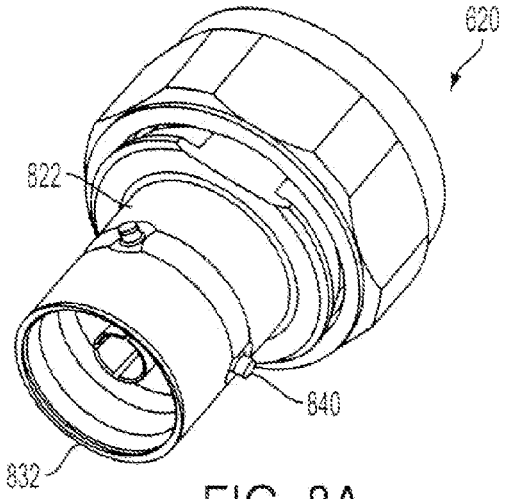
FIGS. 8A and 8B are perspective and cross-sectional views, respectively, of the other component of the connector assembly illustrated in FIG. 6.
Figure 8B:
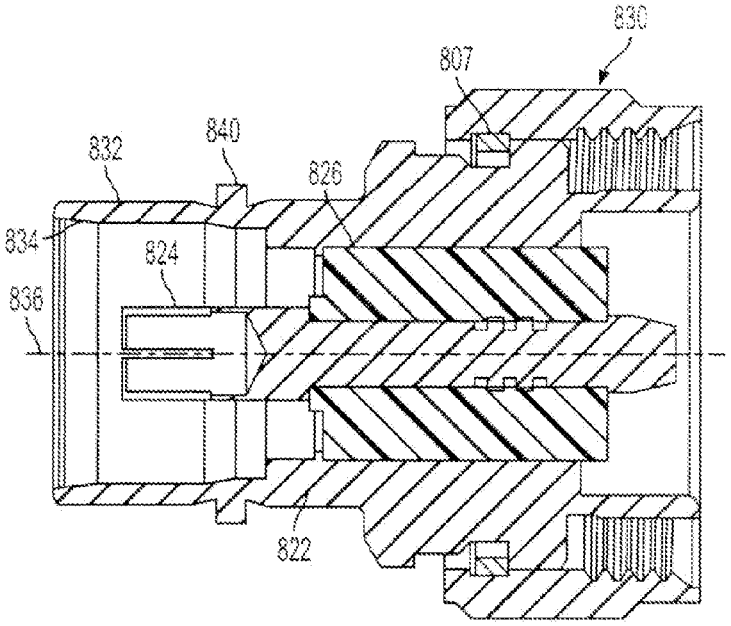

As seen in FIGS. 8A and 8B, the receptacle member 620 generally includes a receptacle body 822 that supports an internal contact 824, such as a female contact or socket, in an insulator 826. The receptacle body 822 includes one end 830 adapted to mount to equipment or an equipment panel and an interface end 832 opposite the end 830. The end 830 is preferably a threaded nut rotatably mounted thereto by a retaining ring 807. The interface end 832 is open to receive the interface end 712 of the plug member 610 and includes an inner tapered surface 834 that corresponds to the tapered surface 714 of the plug body 702 to form friction fit therebetween, thereby by defining an inner engagement between the plug and receptacle members 610 and 620. The tapered surface 834 slopes outwardly from a central longitudinal axis 836 of the receptacle body 822, as best seen in FIG. 8B.

The receptacle body 822 includes one or more, preferably three, engagement members 840, on its outer surface for engagement with the corresponding engagement members 784 of the coupling sleeve 630. The engagement members 840 are preferably detents spaced around the circumference of the receptacle hod 822. The detents 840 are sized to be received in the engagement channels 784 of the sleeve 630 through the open access ends 786 to form a bayonet-type outer engagement as the sleeve 630 rotates on the plug body 702.

Figure 9:
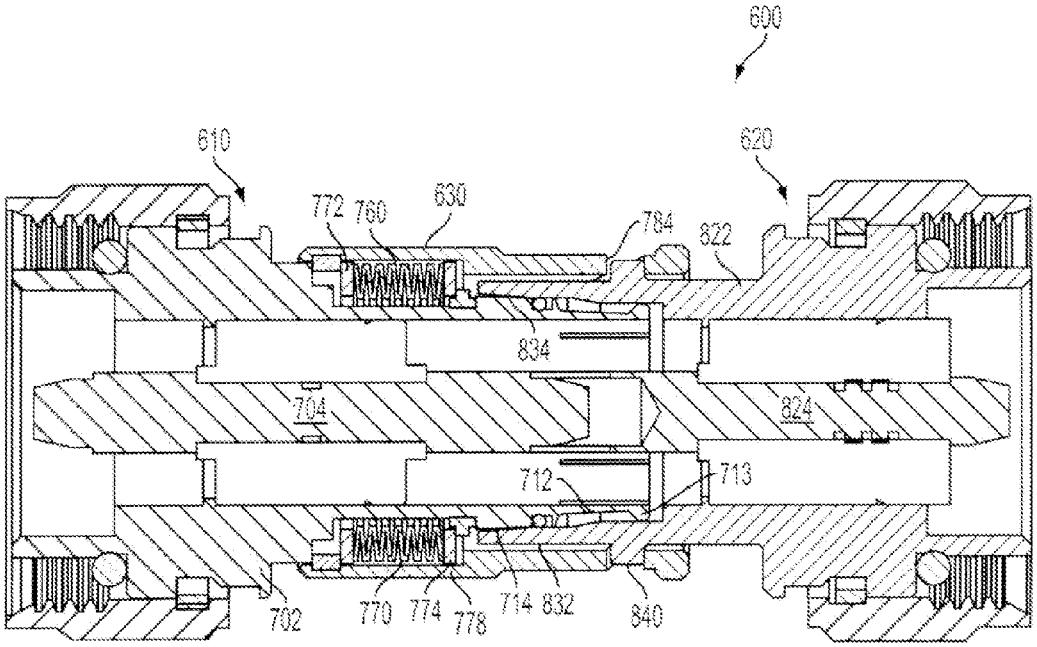
FIG. 9 is a cross-sectional view of the connector assembly illustrated in FIG. 6, showing the components of the connector assembly engaged.

FIG. 9 illustrates the plug and receptacle members 610 and 620 mated with the coupling sleeve 630 in the locked position, thereby ensuring a positive mechanical and electrical engagement between the two components and their respective contacts 704 and 824. To mate the components, the interface end 712 of the plug member 610 is inserted into the interface end 832 of the receptacle member 620 by aligning the open access ends 786 of the channels 784 of the sleeve body 778 with the position of each detent 840 on the receptacle body 822. As the plug member 610 is further inserted, the coupling sleeve 630 is rotated with respect to the plug body 702 and slidably moved toward the receptacle member 620, thereby allowing the detents 840 to ramp up into the channels 784 until the detents 840 reach the hook ends 788 of the channels 784. In addition, the tapered surfaces 714 and 834 engage to form a friction fit. When the plug member 610 is inserted, the interface end 832 of the receptacle body 822 is received in the annular receiving area 760 between the plug body 702 and the sleeve 630. The grounding fingers 713 of the plug member 610 bias outwardly to engage the inner surface of the receptacle interface end 832, thereby providing a grounding path.

When the plug and receptacle members 610 and 620 are mated, as seen in FIG. 9, the spring 770 compresses between the washers 772 and 774 to biases or push the interface end 712 of the plug body 702 into engagement with the interface end 832 of the receptacle body 822. That ensures that the mated plug and receptacle and their tapered surfaces 714 and 834 are forced together, thereby maintain mechanical and electrical connection between the two bodies. That provides an additional mechanism for ensuring a positive connection between the contacts 704 and 824 of the plug and receptacle members 610 and 620. Once the plug and receptacle are fully mated, the force of spring 770 pushes against and translates through the washer 774 to the body 714.

While a particular embodiment has been chosen to illustrate the invention, it will be understood by those skilled in the art that various changes and modifications can be made therein without departing from the scope of the invention as defined in the appended claims. For example, although the plug members are shown as having the male contact and the receptacle members as having the female contact, that may be reversed. Also, the coupling member may be rotatably mounted to either the plug member or the receptacle member and the corresponding engagement members may be provided on the outer surface of either the plug or receptacle body, as appropriate. Additionally, the tapered surfaces one either the plug or receptacle bodies may taper inwardly or outwardly, as long as the tapered surfaces provide a frictional fit between the plug and receptacle members when mated.

What is claimed is:

1. An electrical connector assembly, comprising;

a first connector member including a first connector body supporting a first contact, said first connector body having a first interface end, said first interface end of said first connector defines a first tapered surface;

a second connector member including a second connector body supporting a second contact configured to mate with said first contact of said first connector member, said second connector body having a second interface end that mates with said first interface end of said first connector member, said second interface end of said second connector member having a second tapered surface configured to mate with the first tapered surface, said first and second tapered surfaces having substantially the same angle of taper and taper in opposite directions to engage one another in a friction fit, said friction fit forming an inner engagement between said first and second connector members;

a coupling member mounted near one of said first and second interface ends of said first and second connector bodies, respectively, said coupling member having an engagement member that is configured to engage a corresponding engagement member of the other of said first and second connector bodies to form an outer engagement between said first connector member and said second connector member; and a biasing member disposed in an annular receiving area defined between an inner surface of said coupling member and said one of said first and second connector bodies to which said coupling member is mounted biasing said coupling member toward said one of said first and second interface ends, wherein said coupling member is movable between an unlocked position when said engagement members are not engaged and a locked position when said engagement members are engaged.

2. An electrical connector assembly according to claim 1, wherein said biasing member is a compression spring.

3. An electrical connector assembly according to claim 2, further comprising at least one washer disposed in said annular receiving area adjacent said compression spring that abuts said compression spring when said coupling member moves between said locked and unlocked positions.

4. An electrical connector assembly according to claim 1, wherein each of said engagement members is one of at least one bayonet channel and at least one detent configured to be received in said bayonet channel.

5. An electrical connector assembly according to claim 4, wherein said bayonet channel includes an open access end configured to receive said detent when said coupling member is in said unlocked position and a hook end opposite said open end against which said detent abuts when said coupling member is in said locked position.

6. An electrical connector assembly according to claim 4, wherein each of said engagement members is one of a plurality of bayonet channels and a plurality of detents configured to be received in said bayonet channels.

7. An electrical connector assembly according to claim 1, wherein said first and second connector bodies are formed of a conductive material.

8. An electrical connector assembly according to claim 1, wherein said first contact is a pin and said second contact is a socket that receives said pin.

9. An electrical connector assembly according to claim 1, wherein said engagement members are cooperating threads that form said outer engagement between said first and second connector bodies.

10. An electrical connector assembly according to claim 1, wherein said annular receiving area is configured to receive the other of said first and second interface ends of said first and second connector bodies.

11. An electrical connector assembly according to claim 1, wherein said coupling member is rotatably attached to said one of said first and second connector bodies.

12. An electrical connector assembly according to claim 1, wherein a sealing ring is located between said first and second interface ends.

13. An electrical connector assembly according to claim 1, wherein each of said first and second connector bodies includes an insulator that supports said first and second contacts, respectively.

14. An electrical connector assembly according to claim 1, wherein one of said first and second tapered surfaces tapers inwardly toward a central longitudinal axis of one said first and second connectors; and the other of said first and second tapered surfaces tapers outwardly away from a central longitudinal axis of the other of said first and second connectors.

15. An electrical connector assembly according to claim 1, wherein one of said first and second interface ends includes a plurality of resilient grounding fingers.

16. An electrical connector assembly, comprising:

a plug member including a plug body supporting a male contact, said plug body having an interface end and a cable termination end opposite said interface end, said interface end of said plug body defines a first tapered surface which tapers inwardly toward a central longitudinal axis of said plug body;

a receptacle member including a receptacle body supporting a female contact configured to receive said male contact of said plug member, said receptacle body having an interface end that mates with said interface end of said plug member and an equipment end opposite said interface end, said interface end of said receptacle member having a second tapered surface, said second tapered surface tapers outwardly away from a central longitudinal axis of said receptacle body, said first and second tapered surfaces have substantially the same angle of taper and engage one another to form an inner friction fit engagement between said plug member and said receptacle member;

a sleeve member rotatably mounted to said plug member near said interface end of said plug body, said sleeve member having an engagement member configured to engage a corresponding engagement member of said receptacle body to form an outer engagement between said plug member and said receptacle member; and a biasing member disposed in an annular receiving area defined between an inner surface of said sleeve member and said plug body biasing said sleeve member toward said interface end of said plug member, wherein said sleeve member is movable between an unlocked position when said external engagement members are not engaged and a locked position when said external engagement members are engaged.

17. An electrical connector assembly according to claim 16, wherein said biasing member is a compression spring.

18. An electrical connector assembly according to claim 17, further comprising at least one washer disposed in said annular receiving area adjacent said compression spring that abuts said compression spring when said sleeve member moves between said locked and unlocked positions.

19. An electrical connector assembly according to claim 16, wherein each of said engagement members is one of at least one bayonet channel and at least one detent configured to be received in said bayonet channel.

20. An electrical connector assembly according to claim 19, wherein said bayonet channel including an open access end configured to receive said detent when said sleeve member is in said unlocked position and a hook end opposite said open end against which said detent abuts when said sleeve member is in said locked position.

21. An electrical connector assembly according to claim 19, wherein each of said engagement members is one of a plurality of bayonet channels and a plurality of detents configured to be received in said bayonet channels.

22. An electrical connector assembly according to claim 16, wherein each of said plug and receptacle members includes an insulator that supports said male and female contacts, respectively.

23. An electrical connector assembly according to claim 16, wherein said annular receiving area is configured to receive said interface end of said receptacle member.

24. An electrical connector assembly according to claim 16, wherein said interface end of said plug member including a plurality of resilient grounding fingers adapted to abut an inner surface of said interface end of said receptacle member.

25. An electrical connector assembly, comprising:

a plug member including a plug body supporting a pin contact, said plug body having an interface end and a cable termination end opposite said interface end, said interface end of said plug body defines a first tapered surface which tapers inwardly toward a central longitudinal axis of said plug body;

a receptacle member including a receptacle body supporting a socket contact configured to receive said pin contact of said plug member, said receptacle body having an interface end that mates with said interface end of said plug member and an equipment end opposite said interface end, said interface end of said receptacle member having a second tapered surface, said second tapered surface tapers outwardly away from a central longitudinal axis of said receptacle body, said first and second tapered surfaces have substantially the same angle of taper and engage one another to form an inner friction fit engagement between said plug member and said receptacle member;

a sleeve member rotatably mounted to said plug member near said interface end of said plug body, said sleeve member having at least one bayonet channel configured to engage a corresponding detent of said receptacle body to form an outer engagement between said plug member and said receptacle member; and a spring disposed in an annular receiving area defined between an inner surface of said sleeve member and said plug body biasing said sleeve member toward said interface end of said plug member, wherein said sleeve member is movable between an unlocked position when said bayonet channel and detent are not engaged and a locked position when said bayonet channel and detent are engaged such that said detent abuts a hook end of said bayonet channel.

* * * * *